US006893212B2

(12) United States Patent
Galassi

(10) Patent No.: US 6,893,212 B2
(45) Date of Patent: May 17, 2005

(54) FAN HAVING AN INTERNAL ROTOR MOTOR INCLUDING A RAPID FIXING DEVICE FOR A FAN WHEEL

(75) Inventor: Alvaro Galassi, Fossato Di Vico (IT)

(73) Assignee: Faber S.p.A., Fabriano - Ancona (IT)

( * ) Notice: Subject to any disclaimer, the term of this patent is extended or adjusted under 35 U.S.C. 154(b) by 30 days.

(21) Appl. No.: 10/370,443

(22) Filed: Feb. 20, 2003

(65) Prior Publication Data

US 2003/0161722 A1 Aug. 28, 2003

(30) Foreign Application Priority Data

Feb. 26, 2002 (IT) ..... MI20020097 U

(51) Int. Cl.[7] ..... F01D 25/00

(52) U.S. Cl. ..... 415/121.2; 415/121.1; 416/204 R

(58) Field of Search ..... 415/121.1, 121.2; 416/204 R, 205, 244 R

(56) References Cited

U.S. PATENT DOCUMENTS

| | | | | |
|---|---|---|---|---|
| 2,750,103 A | | 6/1956 | Franke | |
| 4,514,140 A | * | 4/1985 | Knopf | 415/119 |
| 5,664,936 A | * | 9/1997 | Cunha et al. | 416/204 R |
| 5,938,405 A | | 8/1999 | Coleman | |
| 6,527,516 B2 | * | 3/2003 | Crevel | 416/204 R |
| 6,530,748 B2 | * | 3/2003 | Light et al. | 416/169 A |
| 6,558,124 B2 | * | 5/2003 | Bucher et al. | 416/244 R |

FOREIGN PATENT DOCUMENTS

| | | |
|---|---|---|
| DE | 73 28 732 | 3/1975 |
| EP | 0 425 040 | 5/1991 |
| GB | 1128689 | 10/1968 |
| GB | 1 133 873 | 11/1968 |
| NL | 271 213 | 1/1964 |

OTHER PUBLICATIONS

EPO Search Report.

* cited by examiner

*Primary Examiner*—Hoang Nguyen
(74) *Attorney, Agent, or Firm*—Hedman & Costigan, P.C.

(57) ABSTRACT

A fan having an internal rotor motor with a rapid fixing device for a fan wheel, for both centrifugal and axial fans, including a casing (12) containing an electric motor with an internal rotor (13) connected to at least one fan wheel (14, 14') and being enclosed by a protection grid (15) wherein a first coupling element (17, 17'), attached to one end of a motor shaft (16) of the electric motor (13) and a second coupling element (23, 23') in one portion of at least one fan wheel (14, 14'), wherein the first and second coupling elements (17, 17', 23, 23') are complementary to each other and have a polygonal type section, and are fixed by means of reciprocal blocking means (26, 27, 29).

8 Claims, 4 Drawing Sheets

Figure 1A:
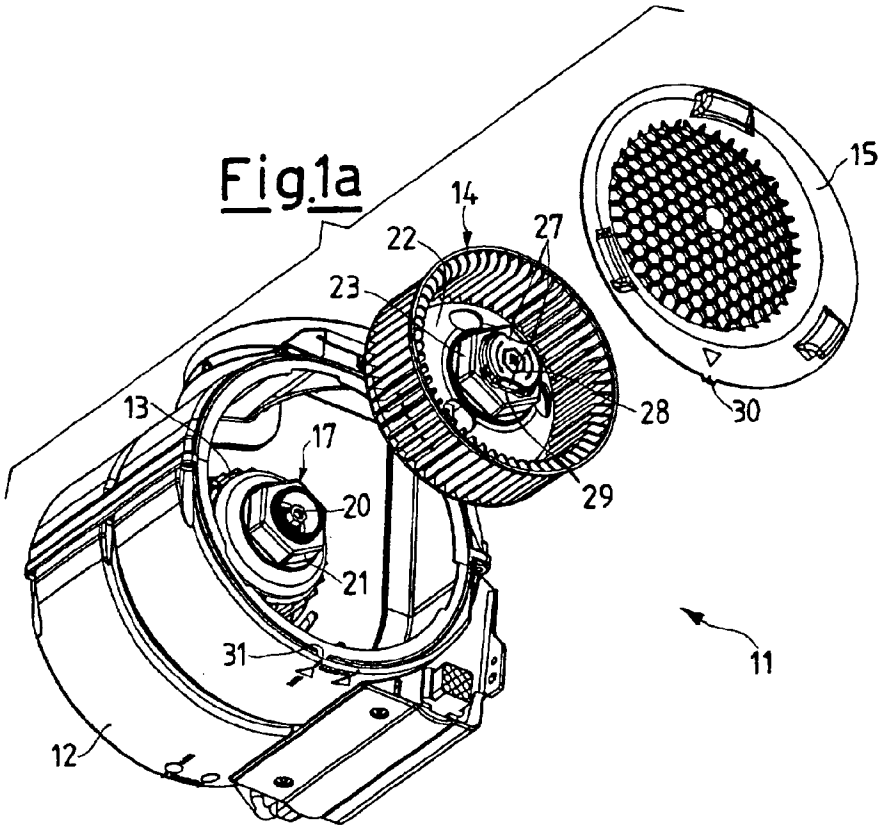

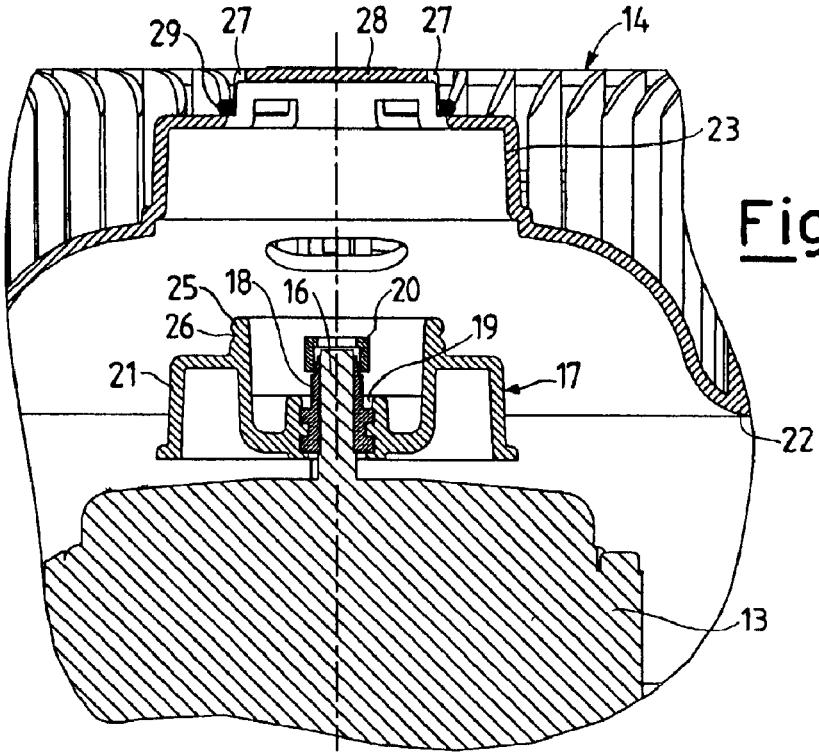
Fig.4
Fig.4a
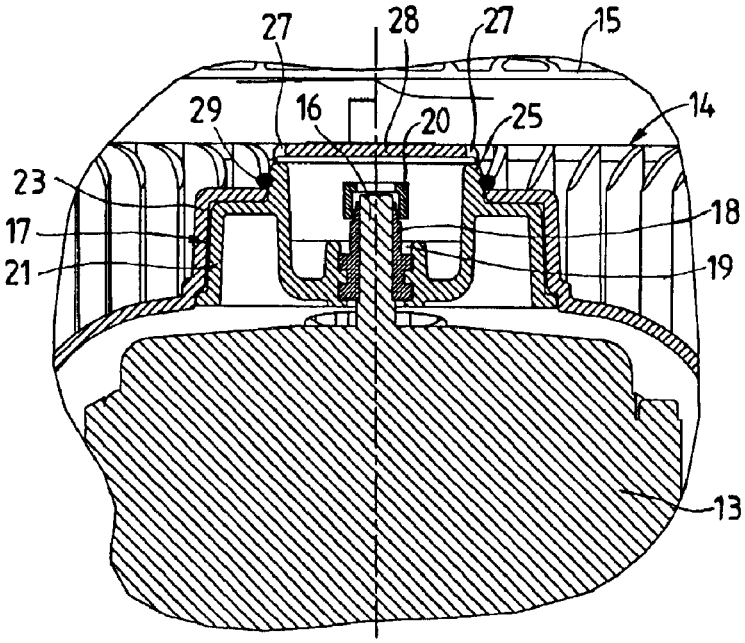

FAN HAVING AN INTERNAL ROTOR MOTOR INCLUDING A RAPID FIXING DEVICE FOR A FAN WHEEL

The present invention relates to a fan with an internal rotor motor having a rapid fixing device for the fan wheel.

Often a centrifugal or axial fan is used to conduct large air streams from the inside of closed environments towards the outside. This is performed by means of suitable evacuation ducts, sucking in air from environments saturated with greasy vapours, variously sized oily particles microdispersed in the air, dust, humidity and various organic particles composing a highly polluting and fouling mixture, and directing them towards surfaces to create an impact, that then slide to deposit subsequent layers of solid particles through speed loss or adhesion. Therefore regular and frequent cleaning of said conductive ducts and the fan wheels of the aspirator/fan that are generally but not exclusively centrifugal is very important to maintain the original performance levels and to eliminate all fire risk provoked by increasing quantities of deposited particles, very often composed of easily inflammable greases.

Currently, centrifugal fan wheels are fixed to internal rotor electric motors that activate the fan motion by means of the following main systems:

Under pressure, on complex motor shafts and complex fan wheel seat. The drawback of this very simple and economical system, is its low reliability level over a period of time due to increased play on generally small sized diameters, due to the lack of seal undercuts, due to the substantial disassembly problems since there are no gripping elements because of reduced size, and due to the same difficulty involved in re-assembly because of the lack of easy reference points for end users generally not expert in this field.

Deformable metal inserts applied to the fan wheel and corresponding external fixing nut, that, when screwed very tightly fixes the fan wheel to the motor shaft by means of mechanical friction due to insert deformation. The drawback caused by this system is the impossibility of repeated disassembly and re-assembly normally carried out in the case of motor replacement, before losing its sealing properties due to permanent deformation. Moreover, said system is inaccessible for normal users, and it has be operated by a man skilled in the art.

With the insertion of the fan wheel suitably shaped around the hole perimeter so that it is inserted into a transversal pin crossing the shaft diametrically, with the successive blocking of the fan wheel by means of a knob screwed on the terminal part of the suitably threaded shaft. The drawback involved with such a system is that it cannot be applied to small sized shafts, and is also expensive because beside the threading, the system involves extremely precise and difficult diametric drilling on a small shaft having a hardened surface, and the reference points are also difficult to identify. Moreover, the system requires the use of an additional knob for unscrewing action in the opposite direction to the rotation direction for safety reasons, and therefore it is not to be considered an intuitive method.

Using a seal dowel positioned on the fan wheel and screwed towards the shaft until it penetrates therein. The drawback result in the impossibility of intervention by the user, as well as the considerable space necessary for rotating the screwdriver.

Accordingly, none of the aforementioned systems meet simplicity, repeatability and facility requirements needed for disassembly and reassembly of fan wheels. These operations are necessary to allow frequent and regular cleaning by both normal end users and maintenance technicians, typically employed in Scandinavian countries. Said problems result in difficulty and long intervention time with subsequent high cost for the consumer.

The general object of the present invention is thus to identify an optimal solution to the aforementioned problems.

In particular, one object of the present invention allows easy, rapid, repeatable, safe disassembly and reassembly without provoking wear on one or two of the fan wheels, respectively by one or two terminal parts of the electric motor shaft, mounted in the fan. In doing so, it must be remembered that said operations must be easily and comfortably carried out by the end user, whether man or woman. Moreover, it must be remembered that the end user usually does not have specific instruments and does not possess the technical background necessary to avoid mistakes during reassembly in order to ensure correct product function and safety.

These objects according to the present invention are achieved realising a fan including an internal rotor motor with a rapid fixing device for the fan wheel as described in the appended claim 1.

Further important and particular characteristics of the present invention are described in the dependant claims.

Figure 1:
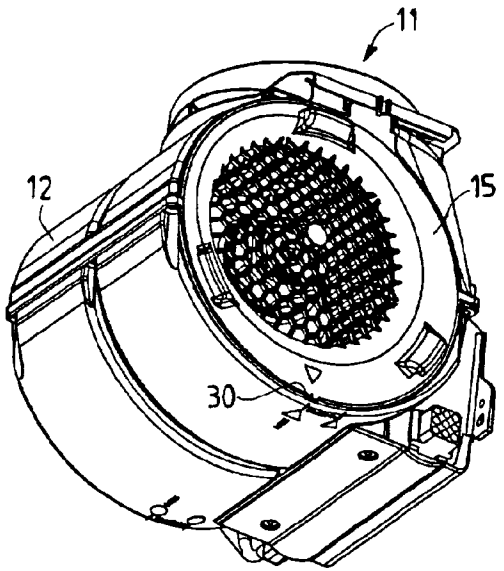
Figure 2:
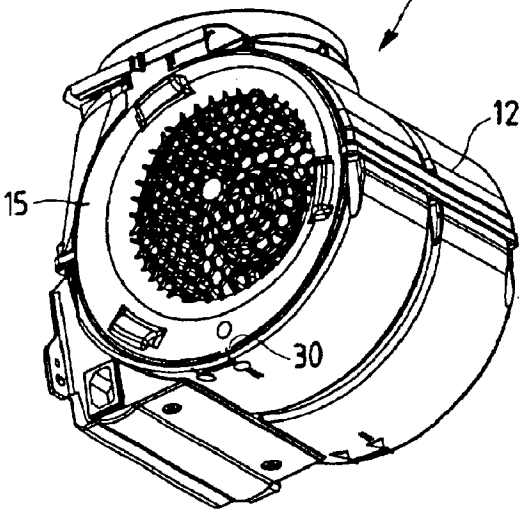
Figure 2A:
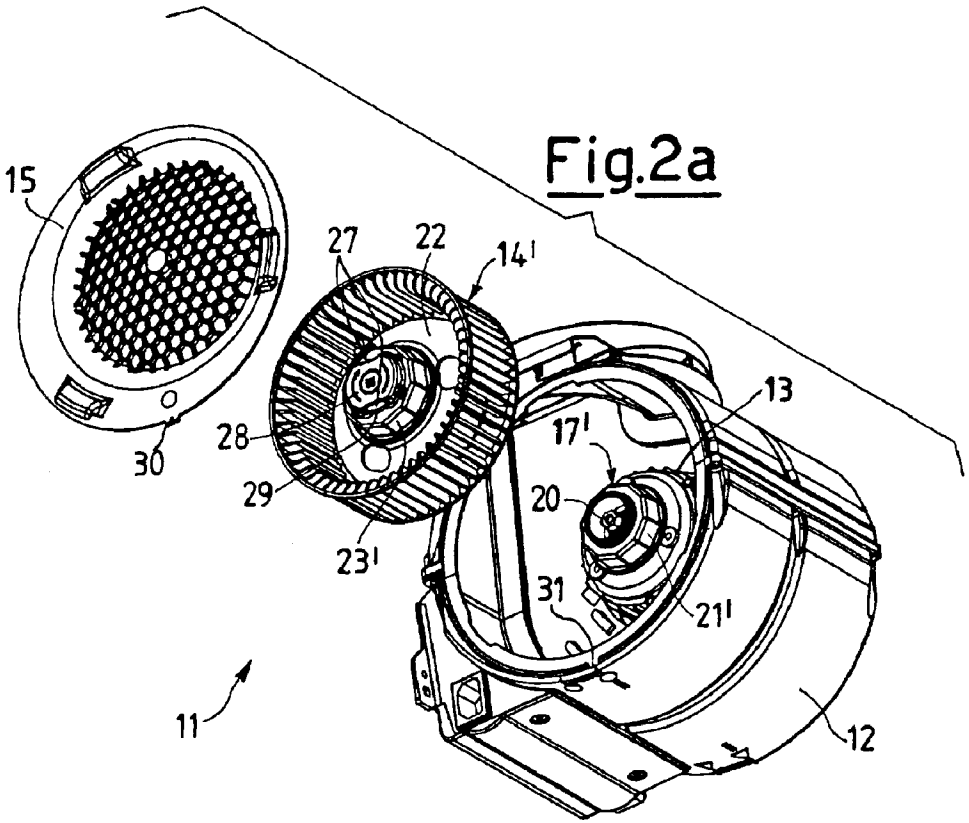
Figure 3:
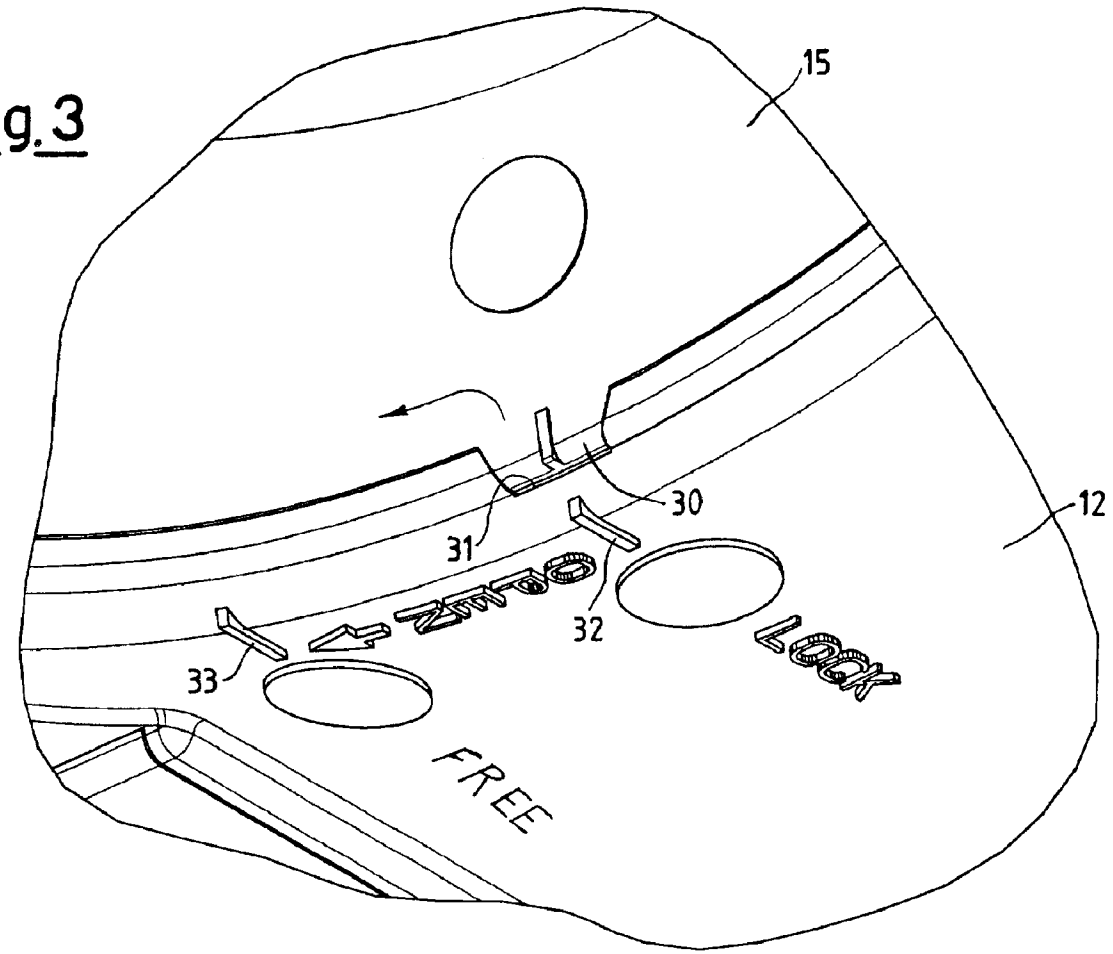

The characteristics and advantages of a fan with an internal rotor motor including a rapid fixing device for a fan wheel according to the present invention will be better appreciated and made clearer in the following description, provided as a non limiting example, of an embodiment with reference to the appended figures in which:

FIGS. 1 and 1*a* show two perspective views of a first end, the one showing the mounted version, and the other one showing an exploded version, of a fan according to the present invention;

FIGS. 2 and 2*a* show perspective views similar to those shown in FIG. 1, of the second end of the same fan according to the invention;

FIG. 3 is a perspective view of an enlarged detail for a better understanding;

FIGS. 4 and 4*a* show enlarged cross sections of certain elements in exploded and coupled versions.

With particular reference to the figures, an example of the embodiment of a fan with internal rotor motor including a rapid fixing device of a fan wheel according to the present invention is identified with reference numeral 11. In particular, FIGS. 4 and 4*a* show a diagram illustrating the rapid fixing device for a fan wheel suitable for fans with internal rotor motors.

FIGS. 1, 1*a*, 2, and 2*a* show how fan 11, that can be either centrifugal or axial, comprises a casing 12 containing an internal rotor electric motor 13, connected to a pair of fan wheels 14, 14', taking into consideration that said system can also include only a single fan wheel.

Casing 12 is closed at each end by means of a protection grid 15. The motor 13 is mounted with a first coupling element 17,17', on each end of its shaft 16, attached to the motor shaft 16 through reciprocal fixing means. In the non limiting example, illustrated in FIGS. 4 and 4*a*, on the first coupling element 17, these reciprocal fixing means include a special sleeve type deforming metal insert 18 fixed in an axial hole 19 in the first coupling element 17 that is housed on the end of shaft 16. A nut 20, is screwed onto the threaded end of the shaft 16, and deforming the insert 18, it blocks the first coupling element 17 in position. Alternatively, this reciprocal fixing means can consist of welding, or blocking by means of a dowel, or faceting and a dowel, etc.

The first coupling element 17, 17', presents an external portion 21, 21', having a polygonal type cross section and a prismatic form.

Each fan wheel 14, 14', is designed to extend out from a portion of the base 22, a second coupling element 23, 23', being included centrally in the fan wheel 14, 14'. The second element 23, 23' is hollow and has a lateral portion with a polygonal type section and a prismatic shape in a manner complementary to that of the external portion 21, 21', of the first coupling element 17, 17'. It should be emphasised that said first coupling element 17,17', attached to motor shaft 16, and said second coupling element 23, 23', attached to the fan wheel 14, 14', are coupled together, after which they are fixed together by reciprocal blocking means.

In the example, the reciprocal blocking means comprise on one hand on a cylindrical extension 25, an external perimetric throat 26 that is aligned on the other hand with the opening 27 in a protruding part 28 of the second hollow coupling element 23, 23', so to receive an elastic element 29. The elastic element 29 is composed of a spring being of an almost circular shape. FIGS. 1, 1*a*, 2, and 2*a* illustrate the opposite ends of shaft 16 carrying two fan wheels 14, 14', different from each other.

In fact, the fan wheels comprise one left wheel and one right wheel due to the orientation of the blades that must be specular and opposite, both rotating in the same direction, and that must not be exchanged with one another. The fan wheels 14, 14' have a portion of the base or plate 22 with the second coupling element 23, 23', and have a shape based on the different polygonal forms. For example, the configuration of the left hand fan wheel is decagonal, while the right hand fan wheel is hexagonal, so that it is physically impossible to exchange their position during reassembly, due to the complementary conformation of the first coupling elements 17, 17', or the second coupling elements 23, 23'. Without this measure and exchanging two fan wheels, fan performance would be reduced by approximately 80% of the original level, although it would cause no safety risk.

This type of coupling with polygonal cross section and prismatic shape is very strong and stable due to the amplitude of the diameter of the circle surrounding said polygon which is at least 3:10 times the diameter of the motor shaft, even if said multiplier is not binding.

It should also be noted that as described above, fan wheel 14, 14', is maintained axially in position by the circular spring 29 inserted in special openings or seats 27 in the protruding part 28, and extending towards the inside of the second coupling element 23, 23', for a distance long enough to be blocked elastically into the dedicated circular throat 26 in the cylindrical extension 25 in the first coupling element 17, 17'.

It should also be noted that each of the protection grids 15 positioned on the two sides of the casing 12 of fan 11, is attached to the casing itself by means of a rotating bayonet, and is maintained in working position by a tab 30 protruding radially towards the outside, and that is inserted in a seat 31 on the open end of the casing 12.

For safety reasons, said block system can be released exclusively by means of a dedicated tool.

In short, to clean the fan wheels 14, 14', on a fan according to the present invention, a small screwdriver must be inserted under tab 30 raising it to release it from the seat 31, then rotating it in the direction indicated by the arrow, and by any written notice (for example OPEN) starting from a first mark 32, (for example LOCK) as far as a second mark 33 (for example FREE).

At this point, the grid 15 can be removed and it is possible to reach the fan wheel 14, 14' that is removed by simply pulling it outwards after having gripped it with the second prismatic central coupling element 23, 23'.

Reassembly is performed in the reverse manner just as simply by pushing and rotating slightly to ensure the automatic alignment of the second coupling element 23, 23', of fan wheel 14, 14', above the first coupling element, 17,17', until the circular spring 29 is engaged.

It is thus demonstrated that a fan with an internal rotor motor with rapid fixing device for a fan wheel according to the present invention achieves the aforementioned objects.

A fan with an internal rotor motor with rapid fixing device for a fan wheel has a particularly simple structure without the need for complicated arrangements.

The fan with an internal rotor motor with rapid fixing device for a fan wheel designed according to the present invention can be subject to numerous modifications and variants without departing from the scope of the invention.

Moreover, all the materials used, as well as their size and components can be of any type according to technical needs.

What is claimed is:

1. Fan with an internal rotor motor with rapid fixing device for a fan wheel, for both centrifugal and axial fans, comprising a casing (12), containing an electric motor with internal rotor (13) connected to at least one fan wheel (14, 14'), and enclosed by a protection grid (15) characterized in that a first coupling element (17, 17') is attached to one end of a motor shaft (16) of said electric motor with internal rotor (13), and second coupling element (23, 23') in a portion of said at least one fan wheel (14,14') wherein said first and second coupling elements (17, 17', 23, 23') are complimentary to each other, have a polygonal type cross section, and are attached through reciprocal fixation means (26, 27, 29) said reciprocal fixation means (26, 27, 29) between said first and second coupling elements (17, 17', 23, 23') are composed of an elastic element (29) that is inserted in a stable manner in hollow portions (27) and throats (26) in one and the other between said first and second coupling elements (17, 17', 23, 23') that said first coupling element (17, 17') attached to an end of a shaft (16) includes a cylindrical extension (25) equipped with an external perimetric throat (26) being aligned with openings (27) inside said second hollow coupling element (23, 23') so to receive said elastic element (29).

2. Fan according to claim 1, characterized in that said first and second coupling element (17, 17', 23, 23') have complementary prismatic shapes.

3. Fan according to claim 1, characterized in that said elastic element has a circular form (29).

4. Fan according to claim 1, characterized in that said first coupling element (17, 17') is blocked on the end of the shaft (16) through reciprocal fixing means constituted of welding, or blocking by means of a dowel, or by means of faceting and a dowel, or by a special metal deformation insert (18) blocked on the shaft by means of a nut (20).

5. Fan according to claim 1, characterized in that said fan is positioned on opposite ends of the said motor shaft of an electric motor, and in that said fan includes two fan wheels (14, 14').

6. Fan according to claim 5, characterized in that each of said two fan wheels (14, 14') has first coupling element (17) different from the other (17'), in the same manner as the second said coupling elements (23, 23') are different so that it is impossible to invert the two fan wheels (14, 14').

7. Fan according to claim 5, characterized in that the slanted blades of a fan wheel (14) are orientated in specular manner compared to those of the other fan wheel (14').

8. Fan according to claim 1 characterized in that said first coupling element (17, 17') attached to one end of a motor shaft (16) has a diameter of the polygonal coupling base of at least one said fan wheel that is considerably larger that the diameter of the end of the shaft, about 3 to 10 times larger.

* * * * *